US008281843B2

(12) United States Patent
Yu et al.

(10) Patent No.: US 8,281,843 B2
(45) Date of Patent: Oct. 9, 2012

(54) ACTUATOR MECHANISM FOR VENETIAN BLINDS

(75) Inventors: Fu-Lai Yu, Taipei Hsieh (TW); Chin-Tien Huang, Taipei Hsieh (TW)

(73) Assignee: Teh Yor Co., Ltd., Taipei (TW)

( * ) Notice: Subject to any disclaimer, the term of this patent is extended or adjusted under 35 U.S.C. 154(b) by 174 days.

(21) Appl. No.: 12/799,055

(22) Filed: Apr. 16, 2010

(65) Prior Publication Data

US 2011/0253321 A1 Oct. 20, 2011

(51) Int. Cl.
*E06B 9/30* (2006.01)

(52) U.S. Cl. ..... 160/170; 160/176.1 R; 160/177 R; 160/173 R

(58) Field of Classification Search ..... 160/168.1 R, 160/170, 173 R, 177 R
See application file for complete search history.

(56) References Cited

U.S. PATENT DOCUMENTS 2,276,716 A * 3/1942 Cardona ..... 160/170
2,397,765 A 4/1946 Sylvanus
2,765,030 A * 10/1956 Bechtler ..... 160/170
3,180,400 A * 4/1965 Rau ..... 160/176.1 R
3,352,349 A * 11/1967 Hennequin ..... 160/171
3,439,726 A 4/1969 Lageson
3,443,624 A 5/1969 Toth
4,200,135 A * 4/1980 Hennequin ..... 160/168.1 R
4,917,168 A * 4/1990 Chen ..... 160/176.1 R
5,628,356 A 5/1997 Marocco
6,009,931 A 1/2000 Peterson
6,431,246 B1 8/2002 Peterson
6,685,592 B2 2/2004 Fraczek et al.
6,945,302 B2 9/2005 Nien
7,137,430 B2 * 11/2006 Fraczek ..... 160/170
7,143,802 B2 12/2006 Strand et al.
7,287,569 B2 10/2007 Lin
7,520,310 B2 * 4/2009 Colosio ..... 160/168.1 R
7,624,785 B2 12/2009 Yu et al.
7,654,301 B2 * 2/2010 Krab et al. ..... 160/171
2004/0182526 A1 9/2004 Strand et al.
2005/0056383 A1 * 3/2005 Huang ..... 160/170
2005/0217805 A1 10/2005 Strand et al.
2007/0039696 A1 2/2007 Strand et al.
2008/0128097 A1 6/2008 Yu et al.
2008/0142169 A1 6/2008 Dekker
2011/0253321 A1 * 10/2011 Yu et al. ..... 160/170

OTHER PUBLICATIONS

PCT International Search Report PCT/US2010/001132 (3 pp.).
PCT Written Opinion PCT/US2010/001132 (6 pp.).

* cited by examiner

*Primary Examiner* — Blair M. Johnson
(74) *Attorney, Agent, or Firm* — Olson & Cepuritis, Ltd

(57) ABSTRACT

An actuator mechanism for window coverings, such as, Venetian blinds that eliminates the use of pull cords and tilting wands is provided. The actuator mechanism includes a stop member engageable with at least one of the slats to stop tilting movement thereof and a clutch arrangement between a drive axle and a tilt control mechanism, responsive to the stop member engaging at least one of the slats, to disengage the tilting force applied to a ladder cord supporting the slats.

13 Claims, 13 Drawing Sheets

Fig. 2
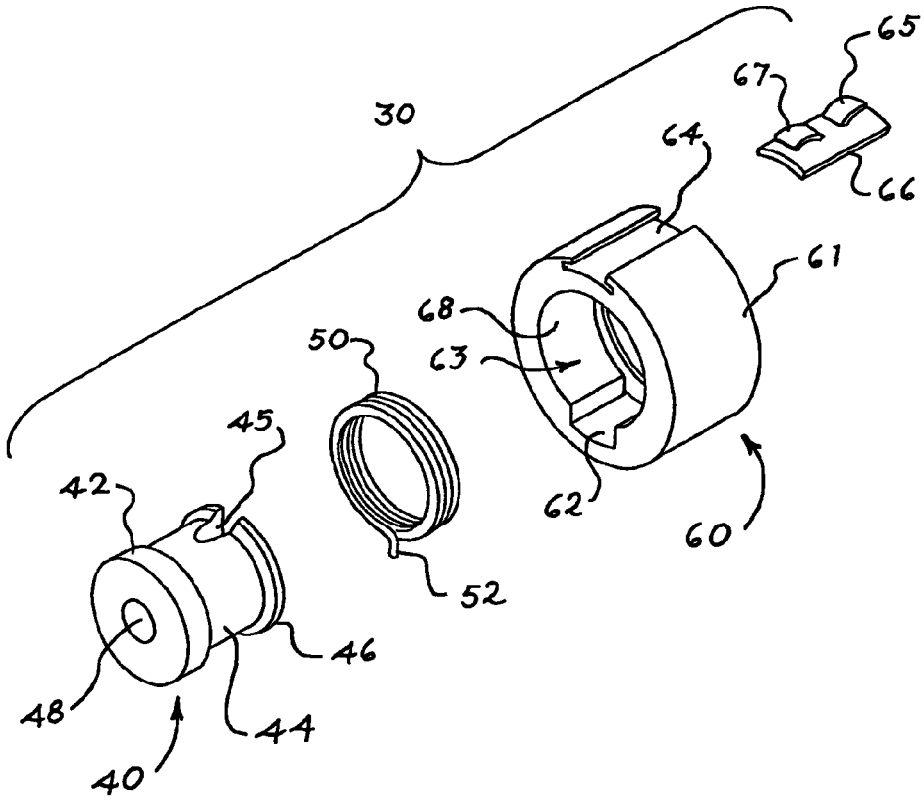
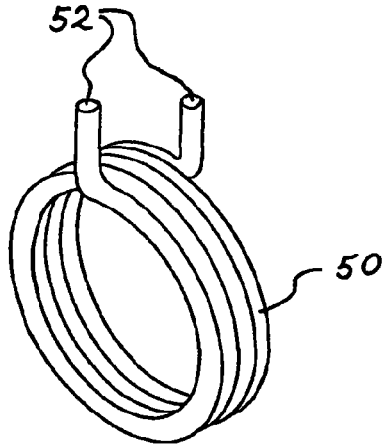
Fig. 3

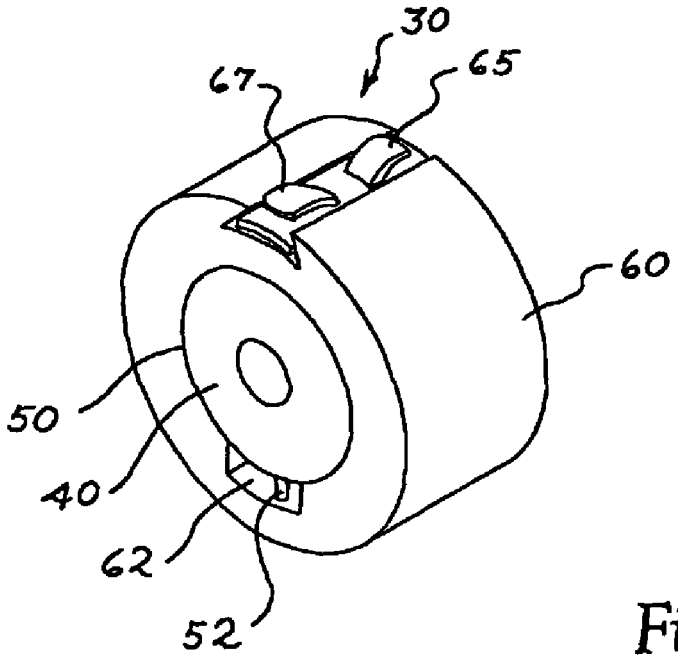
Fig. 4
Fig. 5
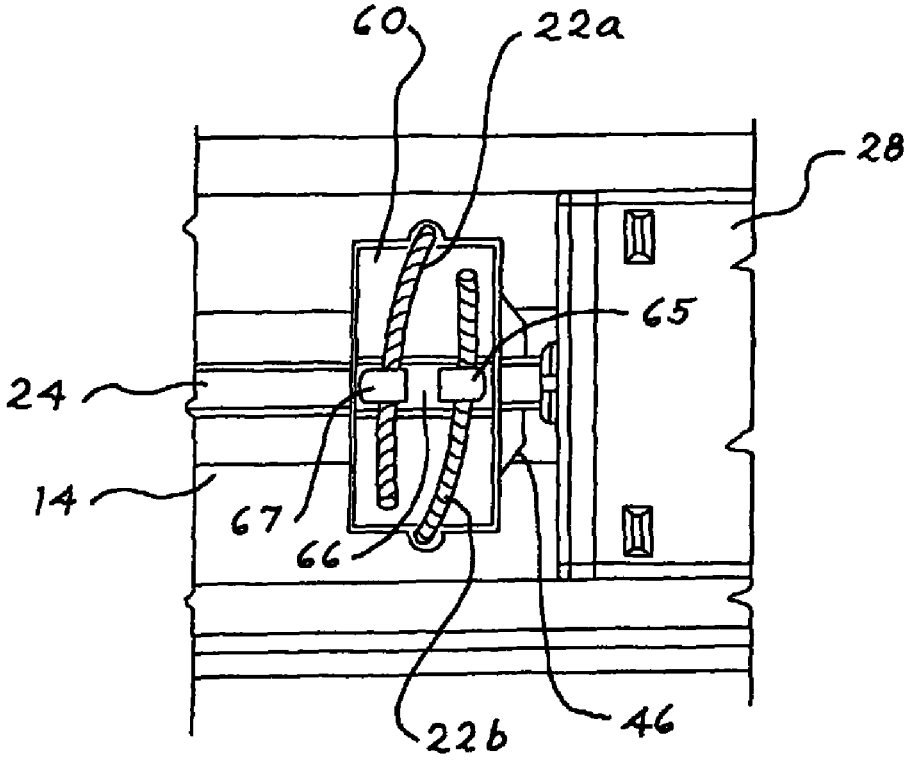

Fig. 14 A
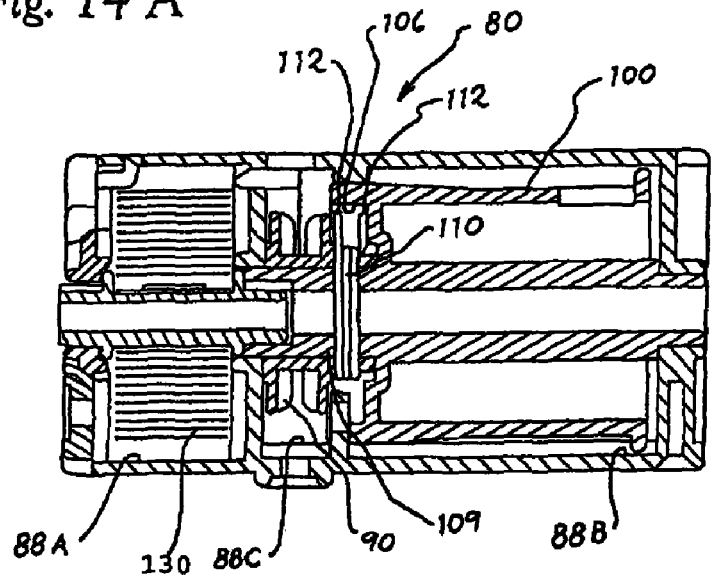
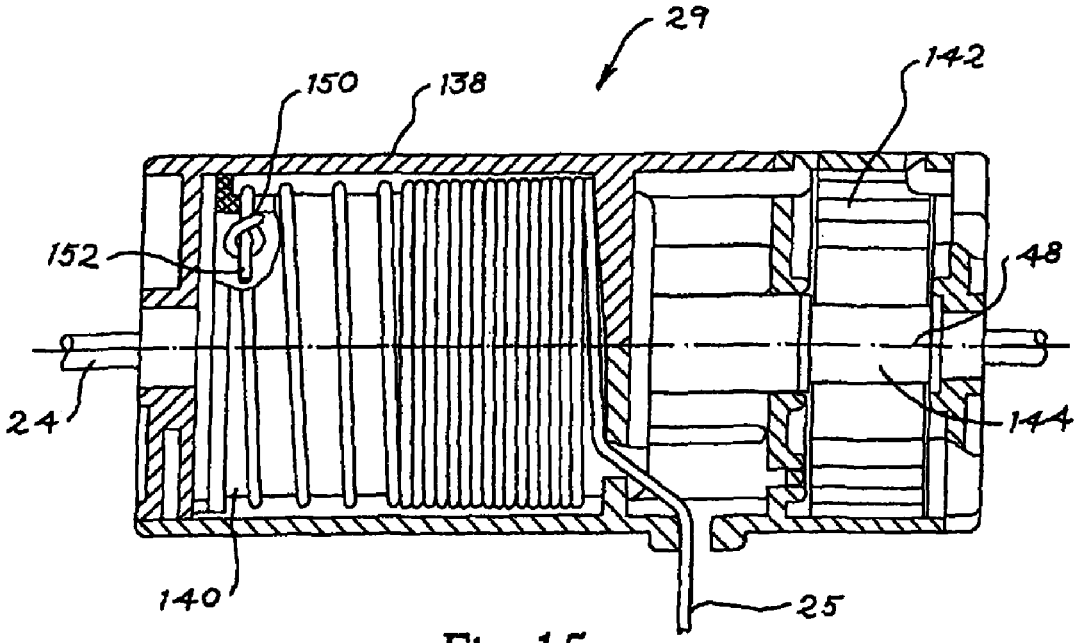
Fig. 15

Fig. 18
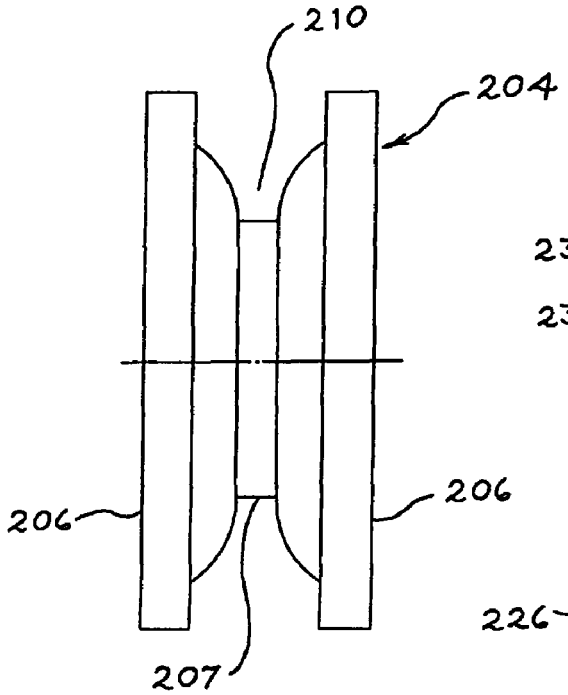
Fig. 22
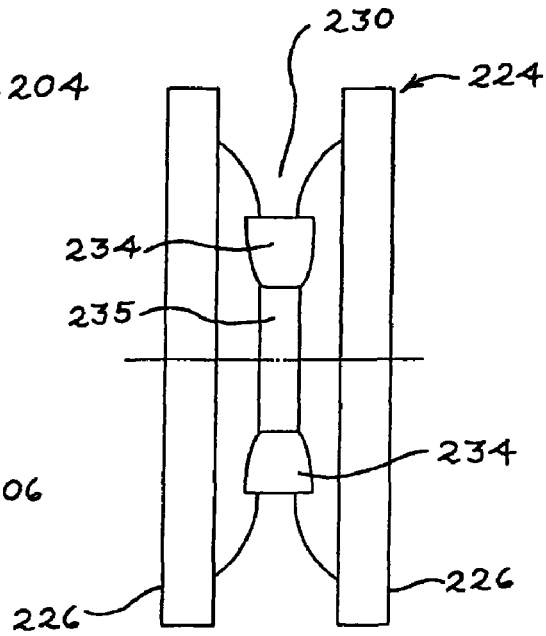
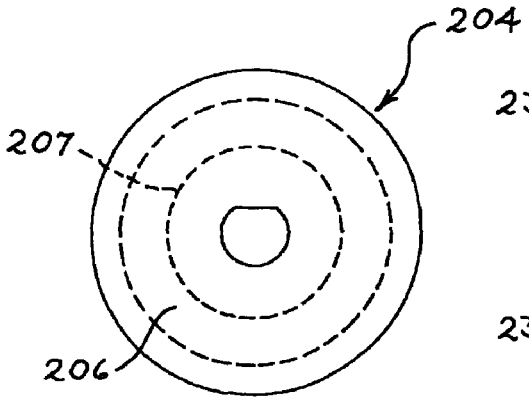
Fig. 19
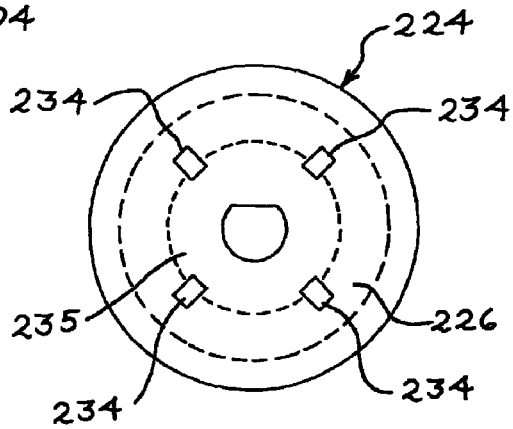
Fig. 23

Fig. 20
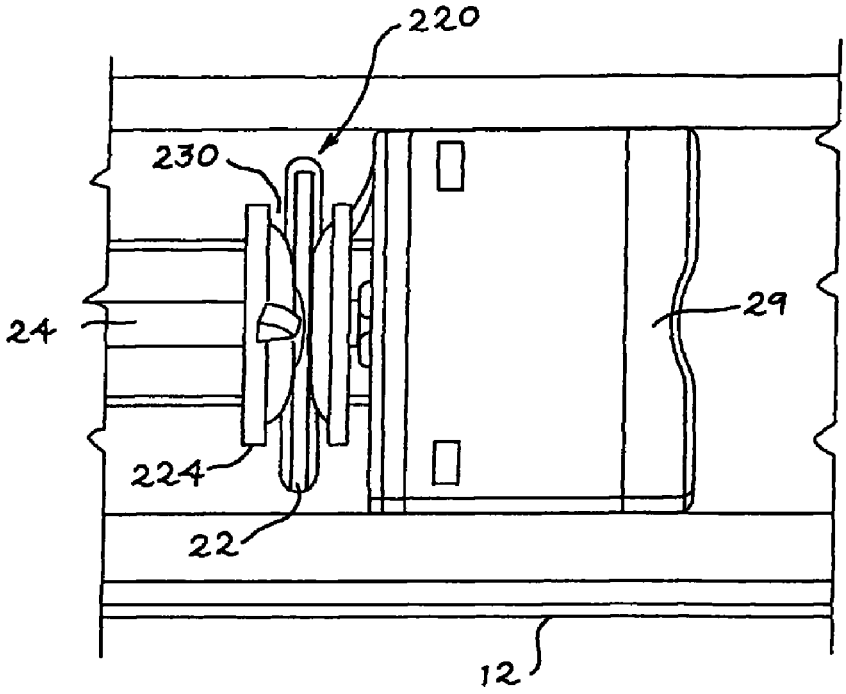
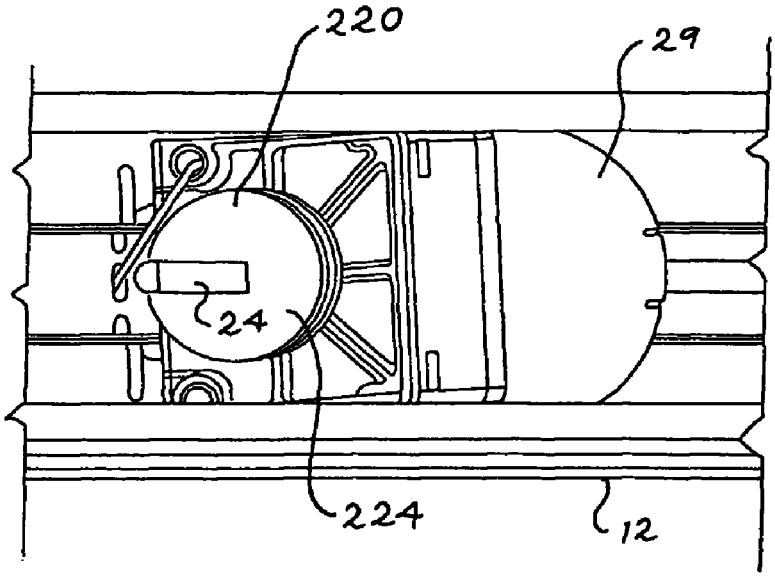
Fig. 21

ACTUATOR MECHANISM FOR VENETIAN BLINDS

TECHNICAL FIELD OF INVENTION

This invention relates to an improved window covering. More particularly, this invention relates to an improved window covering having the ability to tilt, raise or lower the slats of the window covering by operation of its bottom rail.

BACKGROUND OF THE INVENTION

Venetian blinds are a type of window covering comprising horizontal slats, one above another. The slats are typically suspended between an upper rail and a bottom rail by cords. One cord, the ladder cord, is used to control the rotation of the blinds. The other cord, the raising cord, is used to raise and lower the slats. The ladder cord allows the slats to rotate or tilt approximately 180 degrees in either direction. At one extreme the slats are rotated such that they overlap with one side of the slats facing inward and the other sides of the slats facing outward. At the other extreme, the opposite sides of the slats face inward and outward. When the lift cord is pulled, the bottom rail moves towards the upper rail, causing the slats to be stacked one on top of the other.

In most prior art Venetian blinds, an external tilting wand is used to control an operating mechanism that causes the rotation of the slats and an external lift cord is used to control the height of the bottom rail. These components are visible and not aesthetically pleasing. Moreover, the cords pose a choking or strangulation hazard for children. While some prior art Venetian blinds have removed the external tilting wand or lift cord, no such prior art devices have eliminated the needs of the external tilting wand, as well as the external lift cord without severely limiting the function of the blind. Therefore, it is desirable to provide an aesthetically pleasing and safe window blind that does not include either an external tilting wand or an external lift cord.

Therefore, there is a need for an actuator mechanism for controlling the movement of a window covering, such as a Venetian blind, that overcomes the foregoing problems.

SUMMARY OF THE INVENTION

The present invention relates to a cordless actuator mechanism that is suitable for use with a window covering that does not require the use of conventional pull cords to raise or lower the window covering. The present invention is particularly suitable for use with a Venetian blind which includes a head rail, a plurality of slats, a raising cord, and a bottom member suspended from the raising cord to impart vertical adjustments thereto by a user. Other possible window coverings are cellular shades that include adjustable vanes within the cells.

With a Venetian blind a ladder extending from the head rail is provided, which is attached to and supports the plurality of slats for tilting movement thereof. A stop arrangement adapted to limit vertical movement of the ladder cord and the slats suspended therewith, a rotatable drive axle disposed within the head rail having a winding drum member mounted therewith, and a raising cord upper end portion secured with the winding drum member whereby vertical adjustment of the raising cord cooperates with the drive unit for rotation of the winding drum member and the drive axle are also provided. The stop arrangement can take various forms as will be discussed in greater detail below.

A tilting member is rotationally fixed with the drive axle, while an upper portion of the ladder is secured to the tilting member such that rotation of the tilting member applies a tilting force to the ladder to cause the ladder to tilt the slats. A clutch arrangement is provided between the drive axle and the tilting member, which is responsive to the stop arrangement arresting vertical movement of the ladder cord, to disengage the rotational or tilting force from the drive axle from being applied to the ladder.

In one embodiment, the tilting member comprises an outer drum about which the ladder cord is attached. The actuator mechanism further comprises an inner drum member circumferentially mounted about and rotationally fixed to the drive axle, and a collar member, such as a coil spring, comprising the clutch arrangement. The coil spring is circumferentially mounted about the inner drum and has a tightened state whereby the coil spring is engaged with the inner drum, and an expanded state whereby the coil spring is disengaged from the inner drum.

The outer drum is circumferentially mounted about the coil spring. The coil spring is biased toward the engaged condition. The coil spring is moved to the engaged condition by rotation of the winding drum member and the drive axle in response to vertical adjustment of the raising cord, by upward or downward manipulation of the bottom member, which enables a force to be transmitted from the drive axle to the coil spring.

In a second embodiment, the tilting member includes a winding pulley having a hub located between a pair of pulley sidewalls to define a generally V-shaped recess for confining a loop of the ladder cord as the ladder cord is wound about the hub. The pulley sidewalls are responsive to the stop member engaging at least one of the slats to stop tilting movement thereof so as to increase force on the ladder cord loop, causing the ladder cord loop to engage the pulley sidewalls, moving the ladder cord away from the hub so as to disengage the tilting force applied to the ladder cord. In a related embodiment, the hub comprises a plurality of ribs to provide increased engagement with the ladder cord.

BRIEF DESCRIPTION OF THE DRAWINGS

FIG. 2 is an exploded perspective view of part of a tilt control mechanism of the actuator mechanism shown in FIG. 1;

FIG. 3 is a perspective view of a coil spring of the tilt control mechanism shown in FIG. 2;

FIG. 4 is a perspective view of the tilt control mechanism shown in FIG. 2;

FIG. 5 is a top view of an actuator mechanism of the embodiment shown in FIG. 1;

FIG. 14A is a cross-sectional view of the actuator mechanism shown in FIG. 11;

FIG. 15 is a side elevational view of the winding drum assembly of FIG. 6, shown partly in cross-section;

FIG. 18 is a front elevational view of the tilt winding pulley;

FIG. 19 is a side elevational view thereof;

FIG. 20 is a fragmentary side elevational view of an actuator mechanism with another tilt winding pulley;

FIG. 21 is a perspective view thereof;

FIG. 22 is a front elevational view of the tilt winding pulley;

FIG. 23 is a side elevational view thereof;

DETAILED DESCRIPTION OF THE INVENTION

Figure 1:
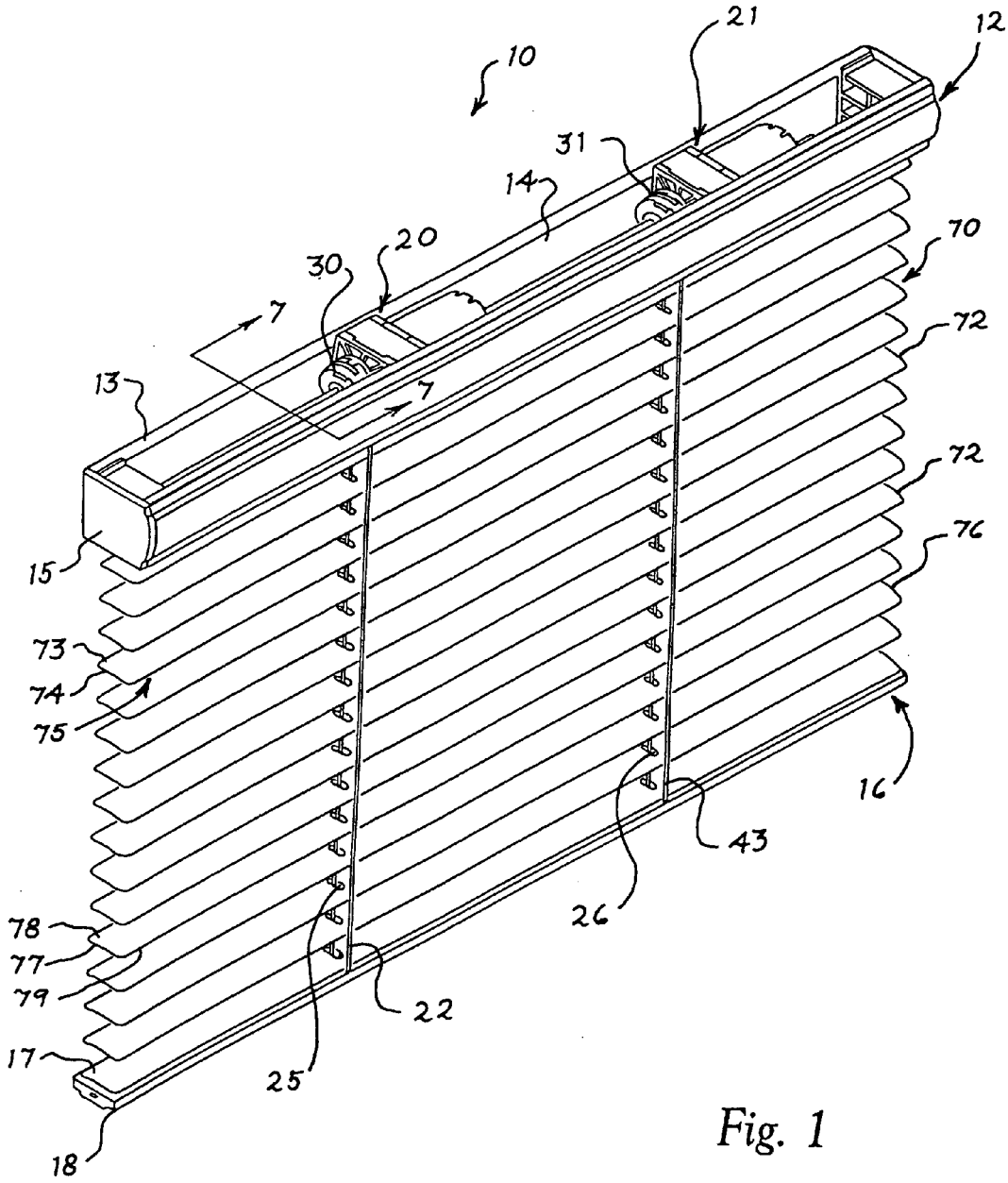
FIG. 1 is a perspective view of a Venetian blind shown in an open configuration, and including an actuator mechanism according to a preferred embodiment of the present invention.

The invention disclosed herein is, of course, susceptible of embodiment in many different forms. Shown in the drawings and described herein below in detail are preferred embodiments of the invention. It is understood, however, that the present disclosure is an exemplification of the principles of the invention and does not limit the invention to the illustrated embodiments.

For ease of description, actuator mechanisms for Venetian blinds embodying the present invention and utilizing a novel drive clutch arrangement, embodied as either a coil spring or a pulley wheel, is described herein below in their usual assembled position as shown in the accompanying drawings, and terms such as upper, lower, horizontal, longitudinal, etc., may be used herein with reference to this usual position. However, the actuator mechanisms may be manufactured, transported, sold, or used in orientations other than and described and shown herein.

A preferred embodiment of the present invention is shown in FIGS. 1 through 10. Referring to FIG. 1, Venetian blind 10 is shown in a fully extended position with its slats opened. The blind 10 includes head rail 12, bottom rail 16, a plurality of slats 70 and actuator mechanisms 20 and 21. Head rail 12 has a rectangular plinth-like shape and includes a bottom side 15 and a substantially open top side 13. The inside of head rail 12 forms a substantially hollow channel 14. As shown in FIGS. 7-10, bottom side 15 of the head rail 12 includes a stop member or first bottom edge 11 (see FIGS. 8 and 10) and a second bottom edge 19 (see FIG. 7). Head rail 12 may be secured to a window or similar surface by means known in the art. It may also include decorative facing without departing from the spirit of the invention.

Referring again to FIG. 1, bottom rail 16 includes top side 17 and bottom side 18. Preferably, the area of top side 17 is substantially equal to the longitudinal area of each individual slat 72, although this is not required. The shape of the bottom rail may vary without departing from the spirit of the invention.

The slat array or plurality of slats 70 comprises a plurality of individual slats 72. Each slat 72 includes a top portion 73 and a bottom portion 74. Top portion 73 and bottom portion 74 are connected together by border 75. Border 75 includes a first edge 76, a second edge 77, a third edge 78 and a fourth edge 79, the third and fourth edge 78 and 79 extending along the width of each slat 72. In the preferred embodiment, the cross-sectional shape of each slat 72 is substantially rectangular. Other shapes may be utilized, however. The number of slats included is determined based on the size of the slats and the desired length, or vertical extent, of the blind.

A tilt control mechanism 30 for tilting the plurality of slats 70 is provided, and is shown in greater detail in FIGS. 2-6. The tilt control mechanism 30 includes an inner drum 40, a clutch arrangement that includes a coupling member, such as coil spring 50, and a tilting member 60 that, in this embodiment, is an outer drum. As shown, the inner drum 40, coil spring 50 and tilting member 60 are comprised of individual components, although other combinations of parts is possible. Inner drum 40 is preferably provided as a monolithic plastic molding and includes an outer surface portion 44 that is generally cylindrical. First and second flange portions 42 and 46 respectively protrude from the outer surface 44 of the inner drum 40 at two axially opposite sides thereof. Through hole 48 is defined by inner drum 40. Through hole 48 is configured to accept insertion of drive axle 24 such that the inner drum 40 is tightly mounted on the drive axle 24 and also rotationally fixed relative to the drive axle. The inner drum 40 can also define a slit 45 cut through the second flange 46 and a portion of the outer surface 44 proximate to the second flange 46. Slit 45 can add some resiliency to the end portion of the inner drum 40 for facilitating its assembly through the tilting member 60.

The tilting member 60 is hollow and generally cylindrical in shape. The tilting member 60 includes an outer surface 61, and defines a recess 63 having an inner surface 68. The inner surface 68 of recess 63 further defines a slot 62. Formed axially on the outer surface 61 is a groove 64. Groove 64 is sized to receive retainer segment 66 that includes clipping tabs 65 and 67 for securely fixing end portions of ladder cord sections 22*a* and 22*b* (FIG. 5), which are front and rear ladder cord sections, to tilting member 60. In this embodiment, the retainer segment 66 and the tilting member 60 are separate components. In other embodiments, retainer segment 66 may also be integrally formed on the tilting member 60. Retainer segment 66 can be shaped to match the radius of curvature of the tilting member 60.

As more clearly shown in FIG. 3, coil spring 50 comprises end portions or prongs 52, which extend in a substantially radial outward direction. The coil spring 50 can have two states, referred to herein as tightened and expanded states. Coil spring 50 is configured such that in a tightened state, it is firmly mounted by way of friction on the outer surface portion 44 of the inner drum 40 between the first and second flange portions 42 and 46. Provided with the coil spring 50, the inner drum 40 can be inserted into recess 63 of the tilting member 60 with the prongs 52 being lodged in the slot 62 thereof. When the coil spring 50 is in the tightened state, the coil spring 50 tightly presses around the outer surface 44 of the inner drum 40 so that the inner drum 40, coil spring 50 and tilting member 60 rotate in unison. When the coil spring 50 is in the expanded state, the coil spring 50 expands so that it no longer tightly grips on the outer surface 44 of the inner drum 40. The inner drum 40 is thus' able to rotate along with the drive axle 24 independent of the coil spring 50 and tilting member 60.

Referring to FIGS. 2-6, the tilt control mechanism 30 includes the coil spring 50 mounted around the inner drum 40. Inner drum 40 and coil spring 50 are mounted within recess 63 of the tilting member 60 with the prongs 52 of the coil spring 50 placed within the slot 62. The height of the first and second flange portions 42 and 46 is preferably sized so as to prevent axial shifting of the coil spring 50 or the tilting member 60 from the inner drum 40. To drive the tilt control mechanism 30, the drive axle 24 is mounted through the hole 48 of the inner drum 40.

Figure 6:
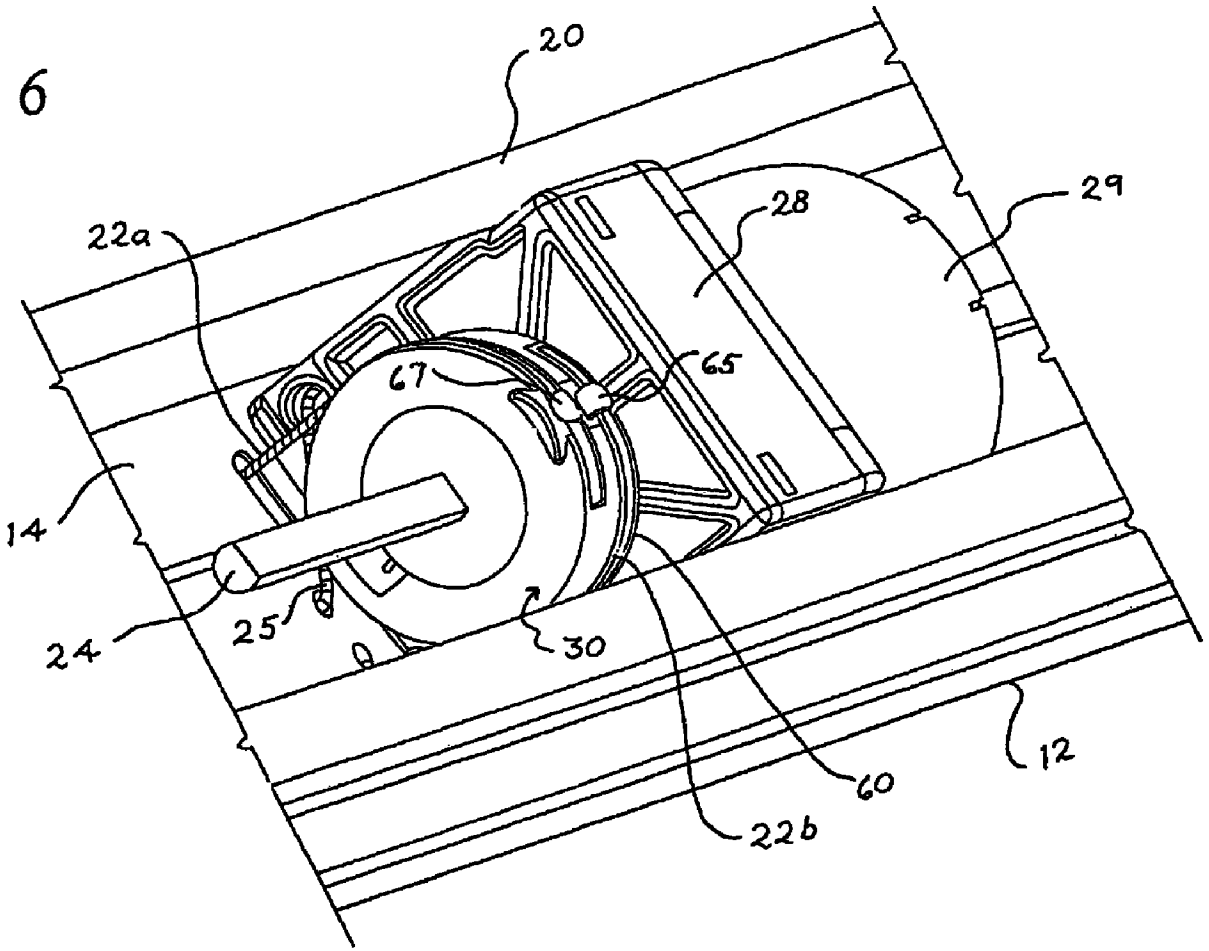
FIG. 6 is a perspective view of the actuator mechanism of the embodiment shown in FIG. 5.

With reference to FIGS. 1, 5 and 6, two ladder cord sections 22*a* and 22*b* are engaged with the clipping tabs 65 and 67 on the retainer segment 66. It will be understood by skilled practitioners that one ladder cord section 22*a* can extend at the front of the Venetian blind 10 and connect with one side edge of the plurality of slats 70 (e.g., fourth edge portion 79), whereas the other ladder cord section 22*b* can extend at the rear of the Venetian blind 10 and connect with an opposite side edge of the plurality of slats 70 (e.g., third edge portion 78). Each of the ladder cord sections 22*a* and 22*b* has an upper end secured with the tilt control mechanism 30, and a lower end secured with the bottom rail 16. Ladder cord sections 43 are secured at one end to another tilt control mechanism 31 and at the other end, to bottom rail 16 in a manner similar to ladder cord sections 22*a* and 22*b*. The plurality of slats 70 can be thereby suspended from ladder cord sections 22*a*, 22*b* and 43. Raising cord 25 extends from the winding drum assembly 29 of the actuator mechanism 20, through an aperture in head rail 12, through the plurality of slats 70, and is fixed at a lower end to bottom rail 16. Raising cord 26 similarly extends from the winding drum assembly of another actuator mechanism 21 similar to the actuator mechanism 20, through an aperture on head rail 12, through the plurality of slats 70 and is secured with bottom rail 16. As will be seen, the bottom rail 16 may be pulled or pushed by a user to impart vertical adjustments to the raising cord and adjust the inclination of, i.e., tilt, the plurality of slats 70.

Referring to FIGS. 5 and 6, the actuator mechanism 20 includes the winding drum assembly 29 and tilt control mechanism 30. The winding drum assembly 29 and tilt control mechanism 30 is mounted with the drive axle 24. In the same manner, actuator mechanism 21 is also mounted on the drive axle 24 and includes a winding assembly and tilt control mechanism similar to those of actuator mechanism 20. The use of a common drive axle 24 to connect multiple actuator mechanisms also provides for a simple and reliable means for synchronization and balancing of the actuator mechanisms to promote even lifting and tilting of the blind. In the embodiment disclosed, two actuator mechanisms are mounted on the drive axle 24. The number of actuator mechanisms utilized depends on the weight and width of the blind, and may vary as needed.

FIG. 15 is a cross-sectional view illustrating one embodiment of the winding drum assembly 29 used for operating the raising cord 25 (for clarity, the tilt control mechanism has been omitted in FIG. 15). As shown, the winding drum assembly 29 includes a support structure, such as housing 138. Positioned within the housing 138 are a winding drum 140 and a motor spring 142 (shown in cross section) axially spaced apart from each other. In this embodiment, the winding drum 140 includes a spindle 144 that is integrally formed with the winding drum 140. The drive axle 24, which defines a longitudinal axis 48, is inserted through and secured with the spindle 144 such that the winding drum 140 and drive axle 24 rotate together. It is preferred that the winding drum 140, spindle 144 and motor spring 142 are coaxial with one another. More specifically, the motor spring 142 can be a spiral spring having a first end fixedly secured on the housing 138 and a second end fixedly secured on the spindle 144. The motor spring 142 exerts a rotational force, i.e., torque, on the drive axle 24 and the winding drum 140 in a direction that winds the raising cord 25 around the winding drum 140. Preferably, the motor spring 142 is a constant force spring that provides a constant amount of force or torque throughout the range of extension of the spring. As each winding drum assembly is mounted on the same drive axle 24, additional winding drum assemblies may be incorporated in a simple and convenient manner for a wider window covering that requires greater lifting force.

The raising cord 25 is secured at a first end 150 to a post 152 formed on the winding drum 140. When the bottom rail is raised, the raising cord 25 is wound around the winding drum 140, which is rotated by the torque from the motor spring 142. When the bottom rail 16 reaches a desired height and the pulling force thereon is removed, a counterbalancing force to the torque from the motor spring 142 enables the bottom rail and plurality of slats to remain in position. This counterbalancing force can include internal friction, and the weight load exerted by the bottom rail and slats stacked thereon on the raising cord 25.

Figure 7:
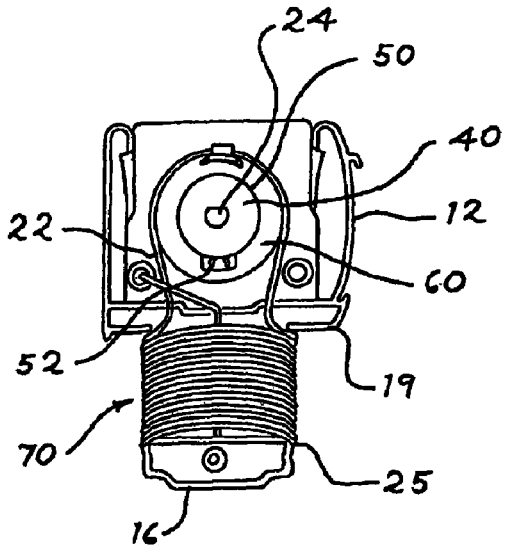
FIG. 7 is a cross-sectional view of the Venetian blind shown in FIG. 1, taken along line 7-7 and shown in a fully retracted configuration.

Reference now is made to FIGS. 7 through 10 to describe an operation of the Venetian blind 10. Shown in FIG. 7 is the Venetian blind 10 of FIG. 1 in a fully raised position. In this configuration, the plurality of slats 70 are stacked on top of each other and rest on the top portion 17 of bottom rail 16 in a substantially horizontal position. The top slat 72 abuts the second bottom edge 19 of head rail 12. In this configuration, coil spring 50 is in its tightened state wherein coil spring 50 tightly holds onto the inner drum 40. Additionally, raising cord 25 is also wound up around winding assembly 29.

Figure 8:
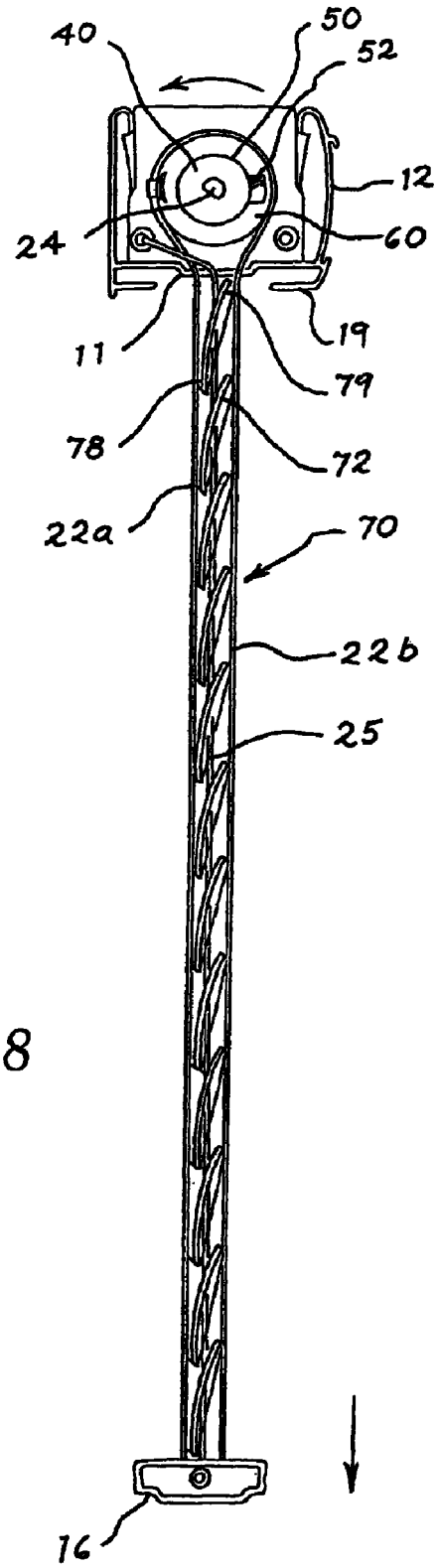
FIG. 8 is a cross-sectional view similar to FIG. 7, but shown in a first closed configuration.

FIG. 8 shows Venetian blind 10 of FIG. 1 in a lowered first closed position. In this position the plurality of slats 70 are in a substantially vertical position wherein bottom portion 74 of the individual slats 72 faces forward. When it is desired to lower the Venetian blind 10, the bottom rail 16 is grasped and lowered from the fully raised position as shown in FIG. 7 toward the position in FIG. 8, i.e. the bottom rail 16 is pulled away from head rail 12. As the bottom rail 16 is pulled away from the head rail 12, the raising cord 25 is unwound from the winding assembly 29, which causes rotation of the winding drum 140 and the drive axle 24 (e.g., in a counterclockwise direction). Rotation of the drive axle 24 causes rotation of the inner drum 40. The rotation of the inner drum, in this configuration is transmitted via the coil spring 50 to the tilting member 60. As a result, one of the ladder cord sections 22*b* is pulled upward while the other ladder cord section 22*a* is moved downward which causes the plurality of slats 70 to tilt in a first direction until each individual slat 72 reaches a first maximum inclination, which may be stopped when fourth edge portion 79 of the top slat 72 abuts the first bottom edge 11 of head rail 12 and/or third edge portion 78 of each individual slat 72 abuts against an adjacent lower slat 72. In one embodiment, the bottom edge 11 of the head rail 12 can thus be engageable with the top slat to act as a stop arrangement to restrict vertical movement of the ladder cord sections 22*a* and 22*b* and to stop tilting movement at a maximum inclination of the plurality of slats 70. This maximum inclination may correspond to a closed position of the Venetian blind 10 where no or a minimal amount of light is allowed to pass through the plurality of slats 70. When tilting of the plurality of slats 70 is stopped at the first maximum inclination, rotation of the tilting member 60 is blocked, and further rotation of the drive axle 24, which is imparted directly to the inner drum 40, causes the coil spring 52 to rotate slightly such that one of the prongs 52 of coil spring 50 presses against a sidewall of the radial slot 62 of the rotationally blocked tilting member 60. As a result, the coil spring 50 expands to an expanded state whereby the inner drum 40 is allowed to rotate as the drive axle 24 continues to rotate, whereas the tilting member 60, coil spring 50 and ladder cord sections 22*a* and 22*b* remain rotationally stationary relative to the drive axle. Because the end portions of ladder cord sections 22*a* and 22*b* are secured to the outside of the tilting member 60, no frictional movement occurs between the ladder cord sections 22*a* and 22*b* and the tilting member 60, thereby preventing wear damage to the ladder cord sections 22*a* and 22*b*. The configuration of the components also allows the drive axle 24 to continue to rotate, thereby allowing the raising cord 25 to be unwound from winding drum assembly 29 and allowing the plurality of slats 70 to be deployed. As a result of the construction of Venetian blind 10, the plurality of slats 70 tilt in one direction and travel downward during this stage of operation.

Figure 9:
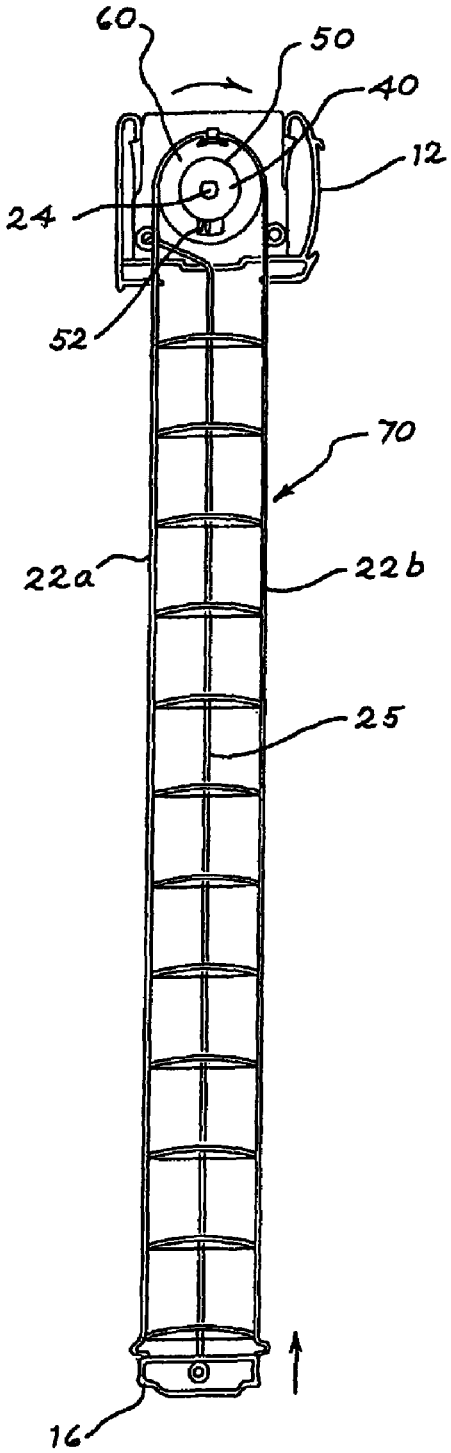
FIG. 9 is a cross-sectional view similar to FIG. 7, but shown in an open configuration.

Shown in FIG. 9 is Venetian blind 10 adjusted to an open and lowered position. In this position, the plurality of slats 70 is in a substantially horizontal position. To reconfigure window blind 10 from the lowered closed position as shown in FIG. 8 to the lowered open position in FIG. 9, bottom rail 16 is slightly lifted towards head rail 12. As this occurs, drive axle 24 rotates clockwise, and prong 52 of the coil spring 50 previously pressed against the corresponding sidewall of the radial slot 62 is no longer urged against thereto. As a result, the coil spring 50 recovers its tightened state on the inner drum 40, such that clockwise rotation of the drive axle 24 again causes the rotational force on the inner drum 40 to be transmitted via the coil spring 50 to the tilting member 60. Accordingly, rotation of the tilting member 60 pulls upward one of the ladder cord sections 22*a* and extends downward the other ladder cord section 22*b*. This action causes the plurality of slats 70 to tilt in a second direction. When the desired amount of tilt is achieved, upward lifting of the bottom rail 16 can be discontinued, and the slats come to rest as shown in FIG. 9.

Figure 10:
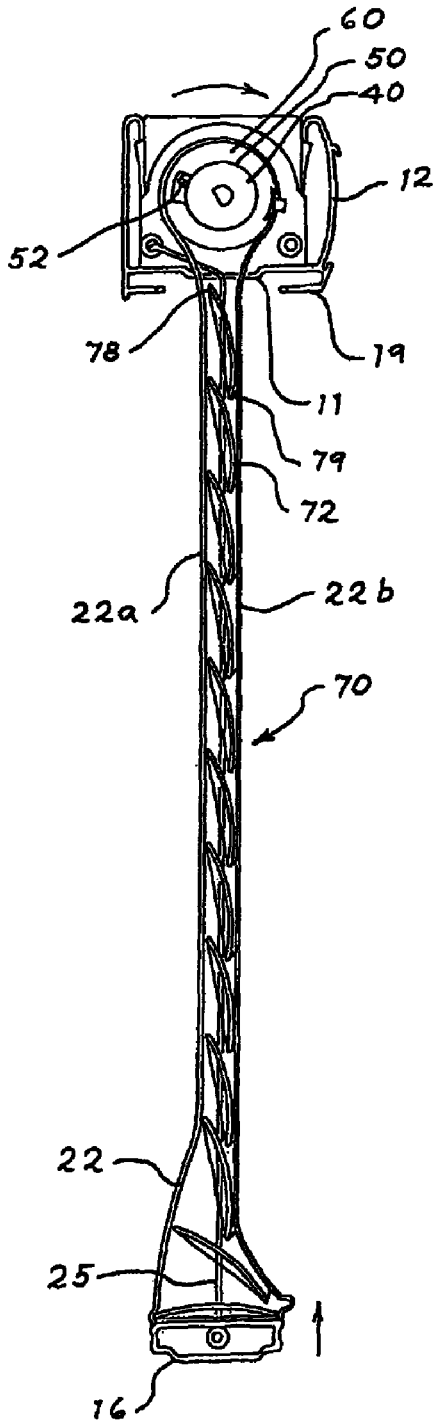
FIG. 10 is a cross-sectional view similar to FIG. 7, but shown in a second closed configuration.

FIG. 10 illustrates an operation for raising the Venetian blind 10 of FIGS. 7-9. When the bottom rail 16 is raised, the drive axle 24 and winding drum assembly 29 are driven in (e.g., clockwise) rotation by action of the motor spring 142, which winds the raising cord 25 around the winding drum assembly 29. The clockwise rotation of the drive axle 24 is imparted to the inner drum 40 and transmitted via the coil spring 50 to the tilting member 60. As a result, the ladder cord sections 22*a* and 22*b* raise and lower, respectively, and cause the plurality of slats 70 to rotate or tilt in a second direction opposite to the first direction until a second maximum inclination of the plurality of slats 70 is reached. The second maximum inclination of the plurality of slats can occur when the slats 72 contact with one another or the third portion edge 78 of the top slat 72 abuts against the first bottom edge 11 of head rail 12. Once the second maximum inclination of the plurality of slats 70 is reached, rotation of the tilting member 60 is blocked. As the bottom rail 16 continues to rise, which causes continued rotation of the drive axle 24, another one of the prongs 52 of the coil spring 50 presses against a corresponding sidewall of the radial slot 62 of the rotationally blocked tilting member 60. As this occurs, the coil spring 50 again expands, thereby allowing rotation of the inner drum 40 with the drive axle 24 relative to the tilting member 60 and the coil spring 50, which will remain substantially rotationally stationary as the drive axle 24 and inner drum 40 continue to rotate. As the drive axle 24 continues to rotate, the raising cord 25 is wound around the winding drum assembly 29 so that the plurality of blinds slats 70 may be progressively raised and stacked on the bottom rail 16. With this construction of Venetian blind 10, the plurality of slats 70 can thus tilt in one direction and slide upward at the same time.

Certain variations in the above are to be understood as being within the scope of the present invention. For example, the directions of rotation of components within the header rail described above may be reversed. Also, the above description of FIGS. 7-10 specifically refer to actuator mechanism 20, however, the description is equally applicable to actuator mechanism 21 as actuator mechanisms 20 and 21 are identical and operate simultaneously because they are both connected to drive axle 24. As will be appreciated, coil spring 50 functions as a clutch arrangement between the drive axle 54 and the tilting member 60, responsive to a stop arrangement which in this embodiment is the bottom wall of the head rail body, engaging the top slat to stop tilting movement of the slats, causing the coil spring to loosen, discontinuing the tilting force applied to the ladder cord sections.

Although the clutching arrangement used to transmit torque between the inner drum 40 and tilting member 60 is preferably embodied as the coil spring 50, the clutching arrangement may comprise other types of known mechanisms wherein the inner drum and the tilting member rotate together and, with sufficient force, is allowed to rotate relative to the tilting member.

For example, the clutching arrangement may be a sleeve that is rotationally secured with tilting member, and thereby frictionally engaged with the inner drum. Upon application of sufficient torque from the drive axle, the static coefficient of friction between the inner portion of the sleeve and the outer surface of the inner drum may be overcome, thereby allowing for relative rotational movement between the tilting member and inner drum. When the torque is discontinued, the static friction again causes the tilting member and inner drum to rotate in conjunction with each other.

Figure 24:
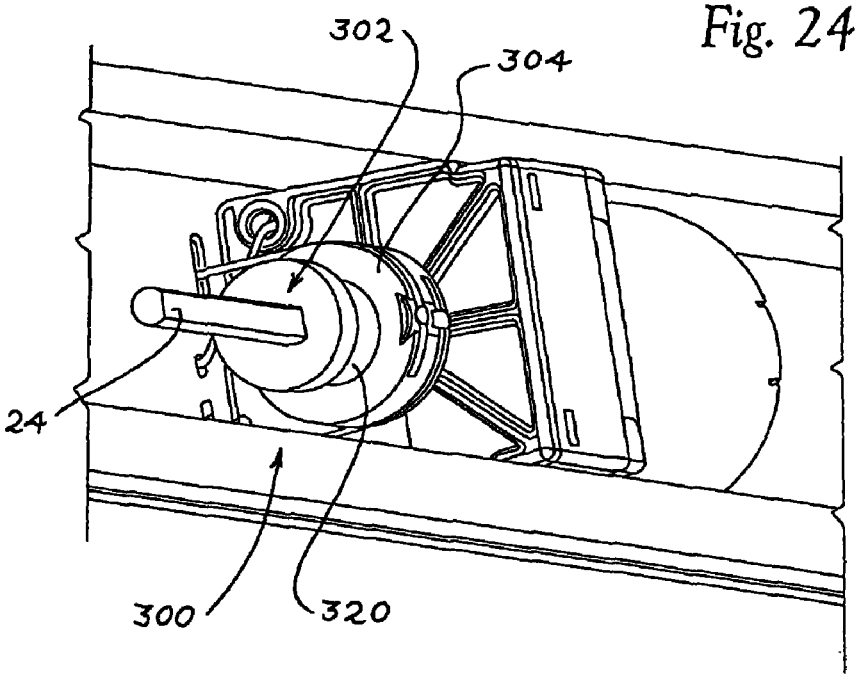
FIG. 24 is a fragmentary side elevational view of an operating mechanism with an actuator mechanism with an alternative clutching arrangement.
Figure 25:
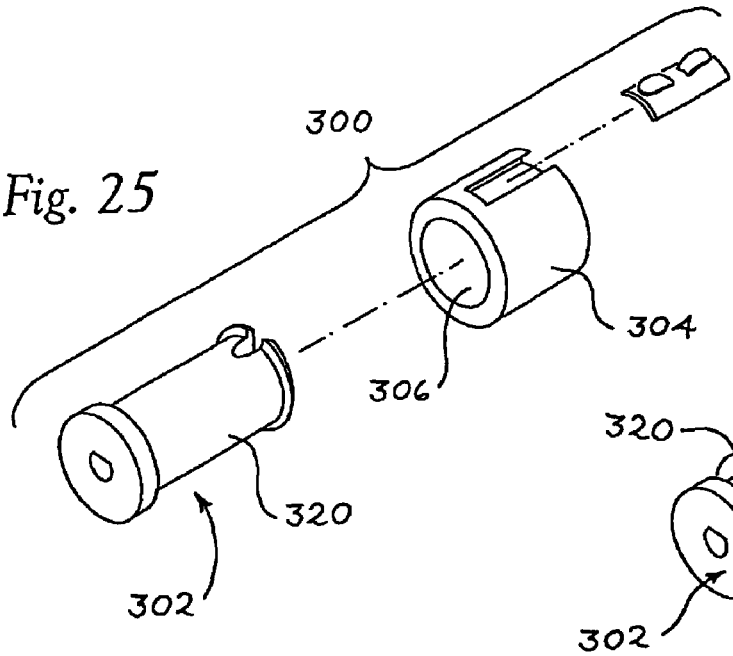
FIG. 25 is an exploded view of the actuator mechanism of FIG. 24.
Figure 26:
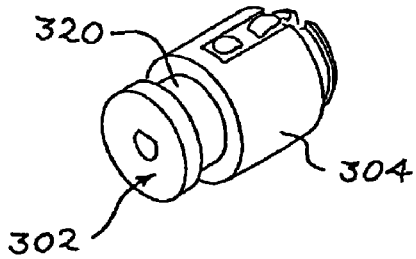
FIG. 26 is a perspective view of the actuator mechanism of FIG. 24.

As yet another alternative, referring to FIGS. 24-26, the outer surface portion 320 of inner drum 302 may fit snugly within an inner portion 306 of the tilting member 304 such that the inner drum 302 is frictionally engaged with the tilting member 304. In such a configuration, no separate intermediate member between the inner drum 302 and the tilting member 304 is necessary. Rather, the static friction between the inner drum 302 and the tilting member 304 are sufficient to enable the inner drum 302 and the tilting member 304 to rotate together. When the static friction is overcome by sufficient force from the drive axle 24 the inner drum 302 may be rotated independent of the tilting member 304.

Another embodiment of the present invention is shown in FIGS. 11-14A. Actuator mechanism 80 includes a winding drum 100, shaft sleeve 109, coil spring 110 having out-turned ends or prongs 112, tilting control mechanism 90, ladder cord sections 84 and raising cord 86. Actuator mechanism 80 is mounted in the head rail 81 with the drive axle 82. Actuator mechanism 80 may replace the actuator mechanism described previously in reference to FIGS. 1-10. As such, actuator mechanism 80 is used to raise, lower and tilt a plurality of blind slats.

Figure 12:
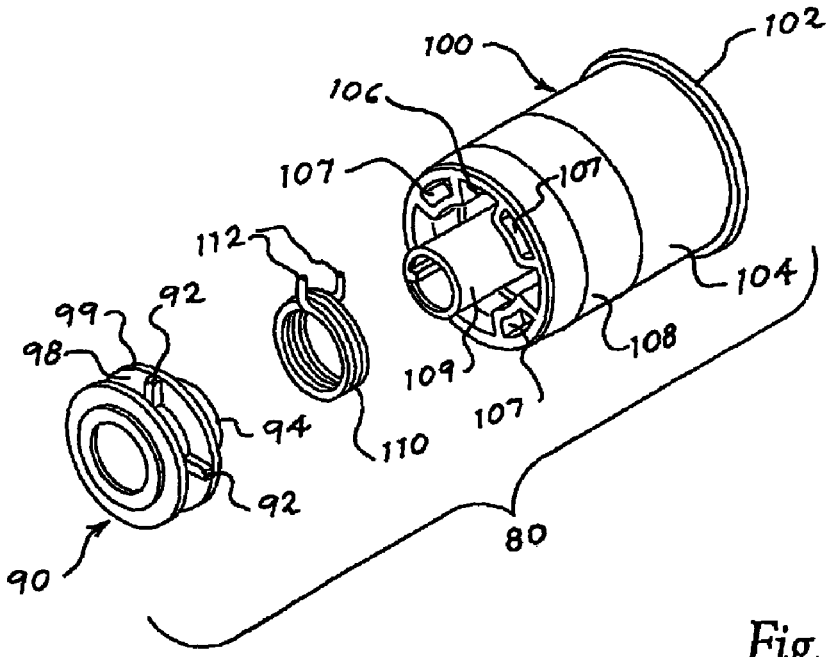
FIG. 12 is an exploded perspective view of the actuator mechanism shown in FIG. 11.

Shown in FIG. 12 is a portion of actuator mechanism 80 wherein the parts are unassembled. In this embodiment, winding drum 100 includes a substantially hollow cylindrical body 104 having a cord-winding barrel 108, and a shaft sleeve 109 extending at one side of the cord-winding barrel 108 and having a diameter smaller than the cord-winding barrel 108. The shaft sleeve 109 has a substantially cylindrical shape and is adapted to mount around the drive axle 82. An inner surface of the cord-winding barrel 108 also includes a radial slot 106 adapted to engage with the prongs 112 of the coil spring 110.

In this embodiment, the tilting control mechanism 90 includes a pulley 98, and a sleeve portion 94 adjoined at one side of the pulley 98. Pulley 98 includes radial ribs 92 for increased gripping of each ladder cord section 84 by the tilting control mechanism 90, which facilitates displacement of the ladder cord sections 84 for tilting the slats.

Figure 11:
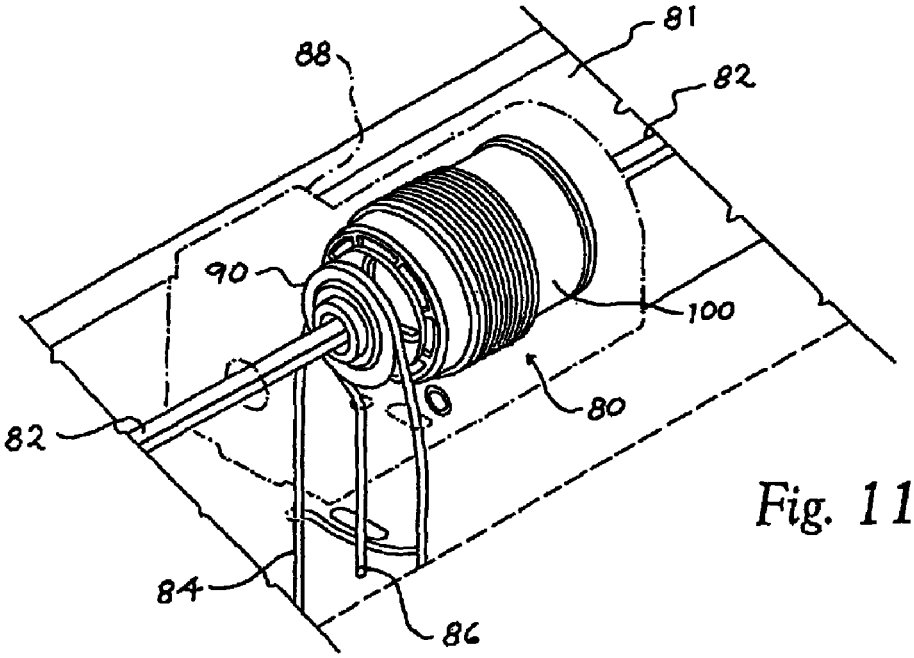
FIG. 11 is a perspective view of a second embodiment of an actuator mechanism according to the present invention.
Figure 13:
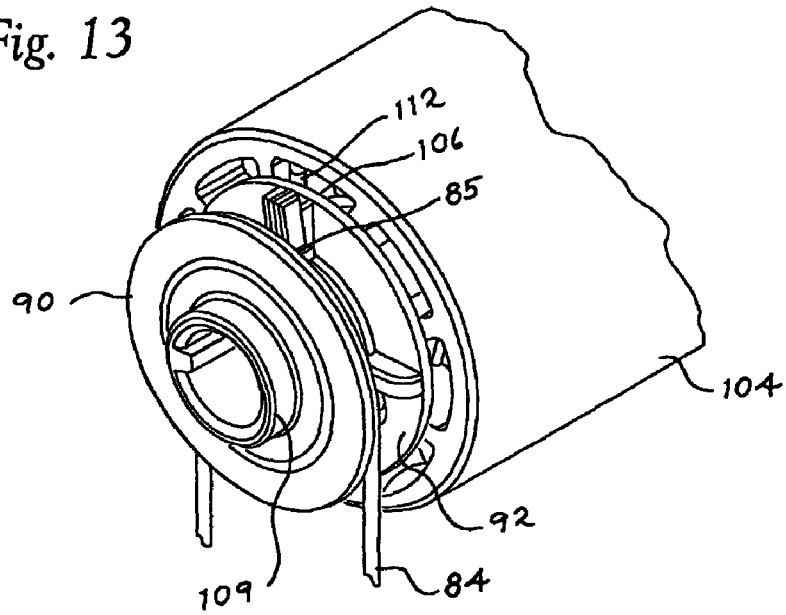
FIG. 13 is a fragmentary perspective view of the actuator mechanism shown in FIG. 11.
Figure 14:
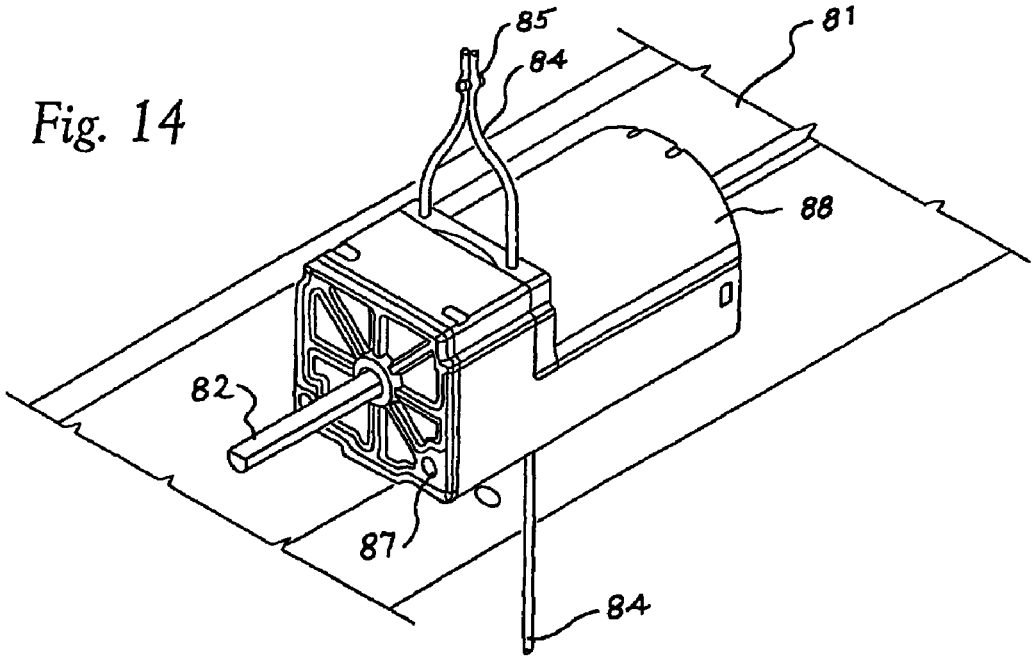
FIG. 14 is a perspective view of the actuator mechanism shown in FIG. 11.

In conjunction with FIGS. 11 and 12, FIG. 13 is an enlarged view of the tilting control mechanism 90 assembled with the winding drum 100 FIG. 14 is a perspective view of the actuator mechanism 80, and FIG. 14A is a cross-sectional view of the actuator mechanism 80 shown in FIG. 14 (for clarity, the drive axle and cord elements are not shown in FIG. 14A). As shown, the coil spring 110 is tightly mounted around the sleeve portion 94 of the tilting control mechanism 90. The shaft sleeve 109 of the winding drum 100 is then mounted through the sleeve portion 94 of the tilting control mechanism 90 provided with the coil spring 110, and the prongs 112 of the coil spring 110 are engaged with the slot 106. As with the previous embodiment, the coil spring 110 has two states. In its tightened state, the coil spring 50 tightly fits around the sleeve portion 94, so that the winding drum 100, coil spring 110 and tilting member 90 can rotate together. In its expanded state, the coil spring 110 expands so that the coil spring 110 loosens its grip on the tilting control mechanism 90. When the coil spring 110 is in the expanded state, as the winding drum 100 is rotated by the drive axle 82, the tilting control mechanism 90 and coil spring 110 remain rotationally stationary relative to the drive axle 82. In this manner, the coil spring 110 acts as a clutch arrangement for coupling and uncoupling rotational movements of the winding drum 100 and tilting control mechanism 90.

Each ladder cord section 84 is engaged with one side of the plurality of blind slats (e.g., one ladder cord section at the front side, and another one at the rear side), and has an upper portion secured about pulley 98. The end portions of the two ladder cord sections 84 are secured together by clip 85 at a location between the ribs 92 of the pulley 98. As shown in FIGS. 14 and 14A, the actuator mechanism 80 can be mounted in a casing 88 having a first compartment 88A, a second compartment 88B, and a third compartment 88C between the first and second compartment 88A and 88B. The first compartment 88A of the casing 88 can house a motor spring 130 used for sustaining the bottom rail 16 in equilibrium at a desired height. In one embodiment, the motor spring 130 includes a constant force spiral spring having a first end secured with the drive axle 82 via an adapter sleeve 132, and a second end secured with the casing 88. The second compartment 88B houses the winding drum 100 coupled with the raising cord 86. In turn, the third compartment 88C houses the tilting member 90 coupled with the ladder cord sections 84, at a position between the cord-winding barrel 108 and the motor spring 130. The drive axle 82 is assembled through the interior of the casing 88, and passes respectively through the winding drum 100, the tilting member 90, and the motor spring 130. With this construction, the actuator mechanism 80 can be assembled in a compact and modular manner, which can be easily mounted with the drive axle 82.

The actuator mechanism 80 may replace the actuator mechanism 20 previously in connection with FIGS. 1-10 for operating the Venetian blind. During operation, the motor spring 130 exerts a force on the drive axle 82, which is converted into an upward force via the winding drum 100 and raising cord 86 for sustaining the weight of the bottom rail 16 and any slats 72 stacked thereon.

When a user wants to tilt the plurality of slats 70 in a first direction, he or she pulls down slightly on the bottom rail 16 within a limited range of displacement. The raising cord 86 is then pulled downward causing rotation of the winding drum 100, which causes the coil spring 110 in its tightened state and the winding drum 100 to rotate. As a result, the tilting member 90 moves the two ladder cord sections 84 in opposite directions to tilt the plurality of slats 70 in the first direction. The plurality of slats 70 continue to rotate and tilt in the first direction as the bottom rail 16 moves downward. Once the plurality of slats 70 reach the desired inclination, the user releases the bottom rail 16. The sum of all the forces applied on the raising cord 86 (including the lifting force generated by the motor spring 130, the weight of the bottom rail 16 and slats stacked thereon, and internal friction force) acts to keep the bottom rail 16 and plurality of slats 70 in equilibrium at the desired inclination.

If the user wants to tilt the plurality of slats 70 in a second direction opposite to the first direction, he or she applies an upward force on the bottom rail 16, which causes rotation of the drive axle 82 and winding drum 100 driven by the motor spring 130. This motion of the winding drum 100 is imparted to the tilting member 90 via the coil spring 110 being in a tightening state. As a result, the tilting member 90 moves the two ladder cord sections 84 in opposite directions to tilt the plurality of slats 70 in the second direction. The plurality of slats 70 continuously tilts in the second direction as the bottom rail 16 rises. Once the plurality of slats 70 reach the desired inclination, the user can release the bottom rail 16.

When a user wants to lower the Venetian blind and deploy the plurality of slats 70 (as shown in FIG. 8), the bottom rail 16 is grasped and lowered away from the head rail 12. As the bottom rail 16 is pulled away from head rail 12, the raising cord 86 is pulled downward, which causes rotation of the winding drum 100 and drive axle 82 (e.g., in a counterclockwise direction). Rotation of the winding drum 100 is transmitted to the tilting member 90 via the coil spring 110 such that one of the ladder cord sections 84 is pulled upward while the other ladder cord section 84 is extended downward, which causes the plurality of slats 70 to tilt in the first direction until they reach a first maximum inclination in the first direction. Tilting of the plurality of slats is stopped when fourth edge portion 79 of the top slat 72 abuts the first bottom edge 11 of head rail 12 and/or third edge portion 78 of each individual slat 72 abuts against an adjacent lower slat 72 (FIG. 1). When the plurality of slats 70 are stopped at the first maximum inclination, further rotation of the tilting member 60 is blocked, and further rotation of the winding drum 100 causes one of the prongs 112 of the coil spring 110 to press against one sidewall of the radial slot 106 and cause the coil spring 110 to move to an expanded state. As a result, the coil spring 110 and winding drum 100 are permitted to rotate as the bottom rail 16 is lowered and the raising cord 86 unwinds, whereas the tilting member 90 and the ladder cord sections 84 held thereon are kept stationary at the first maximum inclination of the slats 70.

When a user wants to raise the Venetian blind and retract the plurality of slats 70 (as shown in FIG. 10), a slight upward force (e.g., less than the weight load on the raising cord 86) can be applied on the bottom rail 16. As a result, the motor spring 130 acts to rotate the drive axle 82 and winding drum 100 (e.g., in a clockwise direction) to wind the raising cord 86 and raise the bottom rail 16. Rotation of the winding drum 100 is imparted to the tilting member 90 via the coil spring 110. As a result, the ladder cord sections 84 causes the plurality of slats 70 to tilt in the second direction opposite the first direction until they reach a second maximum inclination, which may be stopped when the third edge portion 78 of the top slat 72 abuts the first bottom edge 11 of the head rail 12 and/or fourth edge portion 79 of each individual slat 72 abuts against an adjacent lower slat 72 (FIG. 1). When the plurality of slats 70 are stopped at the second maximum inclination, rotation of the tilting member 60 is blocked, and further rotation of the winding drum 100 causes one of the prongs 112 of the coil spring 110 to press against one sidewall of the radial slot 106 and force the coil spring 110 to loosen its grip on the blocked tilting member 60. As a result, the coil spring 110 and winding drum 100 continue to rotate as the bottom rail 16 rises and the raising cord 86 winds around the winding drum 100 driven by the motor spring 130, whereas the tilting member 90 and the ladder cord sections 84 held thereon are kept stationary at the second maximum inclination of the slats 70. The bottom rail 16 can be thereby raised until it reaches a desired height.

Because the ladder cord sections 84 move along with the tilting member 90, no frictional movement occurs between the ladder cord sections 84 and the tilting member 90. When the bottom rail 16 is lowered to deploy the plurality of slats 70, the stationary position of the tilting member 90 and ladder cord sections 84 can eliminate conventional wear damage to the ladder cord sections 84.

Figure 16:
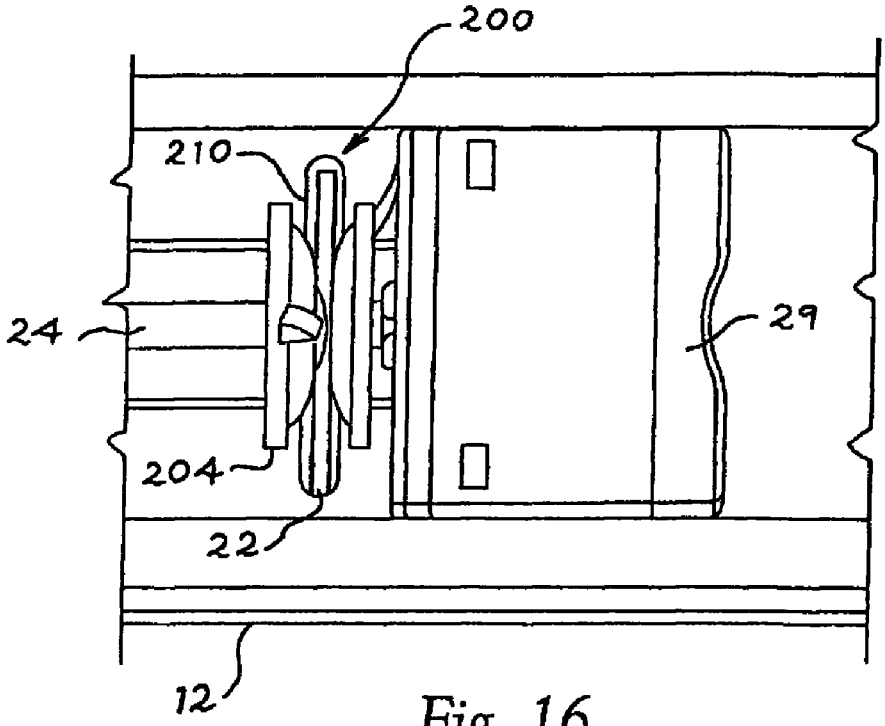
FIG. 16 is a fragmentary side elevational view of an actuator mechanism with an alternative tilt winding pulley.
Figure 17:
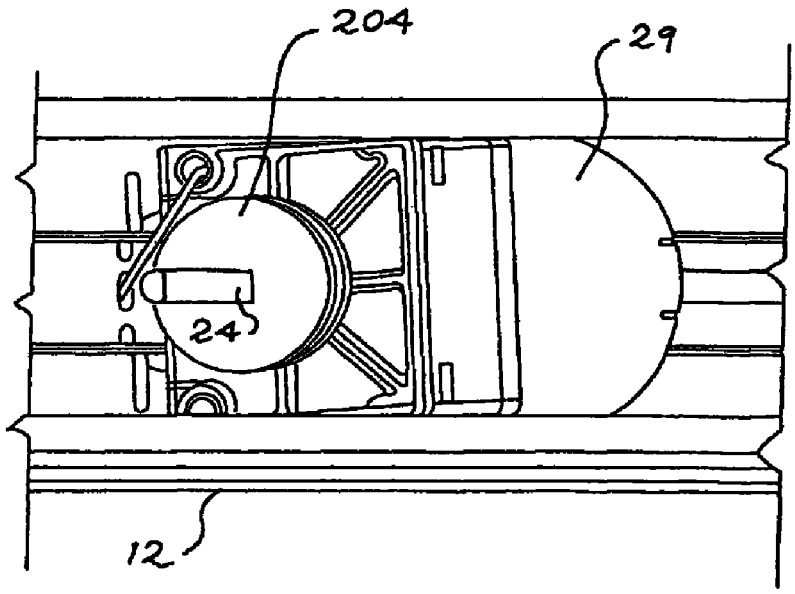
FIG. 17 is a perspective view thereof.

Turning now to FIGS. 16-19, an alternative actuator mechanism 200 is shown. Actuator mechanism 200 includes a tilt control mechanism embodied as tilt winding pulley 204 made of molded plastic or other suitable material. Tilt winding pulley 204 has a central opening through which drive shaft 24 is passed for rotationally coupling the winding pulley 204 with the drive shaft 24. As shown in FIG. 18, tilt winding pulley 204 includes a tilting cylinder or central hub 207 (see FIG. 18) and sidewalls 206 that define an internal V-shaped recess 210, that narrows toward the center of the tilt winding pulley 204. Referring to FIG. 16, the upper end of ladder cord sections 22 is formed in a closed loop, and is inserted within recess 210 so as to contact the surfaces of tilt winding pulley 204 that define recess 210. When the bottom rail is moved upward or downward for tilting the slats, the drive axle 54 can accordingly rotate to drive rotation of the tilt winding pulley 204. Because the loop of ladder cord sections 22 is tightly fitted within the recess 210, rotation of the tilt winding pulley 204 also causes displacement of the ladder cord sections 22 for tilting the slats. When the slats reach the maximum inclination and the drive axle 54 continues to rotate, the ladder cord sections 22 cannot move further and start to slip relative to the tilt winding pulley 204 rotating in unison with the drive axle 54.

FIGS. 20-23 show another alternative tilt control mechanism 220, which includes a tilting member embodied as tilt winding pulley 224 made of molded plastic or other suitable material. Tilt winding pulley 224 is substantially identical to tilt winding pulley 204 in construction and function, except for the addition of radially directed drive ribs 234 that extend from the central hub 235 to provide enhanced engagement with the ladder cord sections.

Tilt winding pulley 224 has a central opening through which drive shaft 24 is passed. As shown in FIG. 22, tilt winding pulley 224 includes side walls 206 that define an internal V-shaped recess 230 that narrows toward the center of the pulley 224. Referring to FIG. 20, the upper ends of ladder cord sections 22 are joined to form a closed loop, and are tightly fitted within recess 230 so as to contact the inner surfaces of tilt winding pulley 204 that define recess 230. When the bottom rail is displaced upward or downward for tilting the slats, the drive axle 54 can accordingly rotate to drive rotation of the tilt winding pulley 224. Because the loop of ladder cord sections 22 is tightly fitted within the recess 230, rotation of the tilt winding pulley 224 also causes displacement of the ladder cord sections 22 for tilting the slats. When the slats reach the maximum inclination and the drive axle 54 continues to rotate, the ladder cord sections 22 cannot move further and start to slip relative to the tilt winding pulley 224 rotating in unison with the drive axle 54. With this construction, a separate clutch arrangement is not required, but is instead integrated into the tilt control mechanism.

The stop arrangement for limiting vertical movement of the ladder cord sections has been described as an engagement between and edge of a topmost slat with the head rail, or contact between adjacent slats tilted to their maximum inclination. However, the stop assembly may also take other forms. For example, another alternative stop arrangement is the inclusion of protrusions or other detent arrangements on the tilting drum that will engage a fixed catch structure within the head rail.

In addition to the clutching arrangements described above, other clutching arrangements may be suitable. For example, the winding drum and the tilt control mechanism may be engaged to one another by way of static friction, such as being positioned in an abutting coaxial arrangement. When sufficient force is exerted on the winding drum and rotation of the tilt control mechanism is stopped by the stop arrangement, the static friction could be overcome and the winding drum allowed to rotate independent of the tilt control mechanism. An adjustable spring can be incorporated to adjust or otherwise vary the amount of static friction between the winding drum and the tilt control mechanism. Yet another possible clutching arrangement would be similar to the embodiment shown in FIGS. 16-19, wherein the winding drum and the tilt control mechanism are an integral unit having a winding portion connected to the raising cord and a tilting portion connected to the ladder cord.

The foregoing descriptions and the accompanying drawings are illustrative of the present invention. Still other variations and arrangements of parts are possible without departing from the spirit and scope of this invention.

We claim:

1. An actuator mechanism for a blind having a head rail, a plurality of slats, and a bottom member the actuator mechanism comprising:

a rotatable drive axle having a winding drum rotationally coupled therewith;

a motor spring assembly operatively coupled with the drive axle; a raising cord having first end portion adopted to connect with the winding drum and second end portion adapted to connect with the bottom member;

a ladder cord adapted to connect with the slats and operable to tilt the slats;

a rotary tilt control mechanism mounted within the head rail, a portion of the ladder cord being secured thereto, the tilt control mechanism adapted to adjust the ladder cord and cause tilting of the slats; and a clutch arrangement operable to selectively engage the winding drum and the tilt control mechanism, the clutch arrangement having an engaged state and a disengaged state, wherein the tilt control mechanism is driven by rotation of the drive axle to adjust the ladder cord when the clutch arrangement is in the engaged state, and the clutch arrangement is switched from the engaged state to the disengaged state by actuation of a stop arrangement limiting vertical adjustment of the ladder cord, the stop arrangement comprising a first slat of the plurality of slats urged against a second slat of the plurality of slats, the drive axle and the winding drum rotating independent from the tilt control mechanism when the clutch arrangement is in the disengaged state;

wherein the drive axle respectively receives a first torque from gravity action applied on the bottom member, and a second torque applied by the motor spring assembly opposite to the first torque;

the second torque applied by the motor spring assembly being adapted to keep the bottom member in stationary equilibrium at a plurality of vertical heights, and to cause rotational displacement of the drive axle and the tilting portion to tilt the ladder cord as the bottom member is moved toward the head rail.

2. The actuator mechanism according to claim 1, wherein the tilt control mechanism comprises an outer drum about which the ladder cord is attached, the actuator mechanism further comprising:

an inner drum mounted about and rotationally fixed with the drive axle; the clutch arrangement including a collar member having at least one end, the collar member mounted about the inner drum;

the collar member having an engaged condition the collar member being frictionally engaged and rotationally fixed with the inner drum when in the engaged condition;

the collar member further having a disengaged condition, the collar member being rotationally moveable relative to the inner drum when in the disengaged condition;

the outer drum mounted around the collar member; and the collar member being biased toward the engaged condition, with the collar member being moved to the disengaged condition by rotation of the winding drum and the drive axle in response to actuation of the stop arrangement.

3. The actuator mechanism according to claim 2, wherein the collar member is a coil spring.

4. The actuator mechanism according to claim 2, wherein the collar member is a coil spring with a pair of out-turned ends, the outer drum including a recess for receiving the out-turned ends so as to apply a force thereto as the outer drum is rotated relative to the coil spring.

5. The actuator mechanism according to claim 1, wherein the tilt control mechanism includes a pulley around which the ladder cord is wrapped.

6. The actuator mechanism according to claim 5, wherein the pulley includes a recess delimited between two opposite sidewalls, the ladder cord being wrapped in the recess.

7. The actuator mechanism according to claim 6, wherein at least one of the sidewalls includes a plurality of radial ribs for facilitating gripping of the ladder cord.

8. The actuator mechanism according to claim 1, wherein the tilt control mechanism includes a winding pulley having a hub located between a pair of pulley sidewalls to define a generally V-shaped recess for confining the ladder cord as the ladder cord loops about the hub, the pulley sidewalls response to actuation of the stop arrangement causing the ladder cord to engage the pulley sidewalls, and to disengage from the hub.

9. The actuator mechanism according to claim 5, further comprising a housing that encloses at least the tilt control mechanism and winding drum member, and wherein the pulley is assembled within the housing.

10. A window covering comprising:

a head rail;

a drive unit having a motor spring assembly;

a rotatable drive axle operatively connected with the motor spring assembly and disposed within the head rail;

a winding portion coupled with the drive axle, the winding portion rotating along with the drive axle to wind and unwind a raising cord;

a bottom member connected with the raising cord;

a tilting portion in selectable engagement with the drive axle, the tilting portion adapted to tilt a ladder cord;

a plurality of slats disposed between the head rail and the bottom member, the slats being connected with the ladder cord; and a clutch arrangement having an engaged condition and a disengaged condition, wherein the ladder cord is driven by a rotation of the drive axle when the clutch arrangement is in the engaged condition the clutch arrangement is switched from the engaged state to the disengaged state by actuation of a stop arrangement limiting vertical adjustment of the ladder cord, and the drive axle rotates independent from the tilting portion when the clutch arrangement is in the disengaged condition, the stop arrangement comprising a first slat of the plurality of slats urged against a second slat of the plurality of slats;

wherein the drive axle respectively receives a first torque from gravity action applied on the bottom member, and a second torque applied by the motor spring assembly opposite to the first torque;

the second torque applied by the motor spring assembly being configured to keep the bottom member in stationary equilibrium at a plurality of vertical heights, and to cause rotational displacement of the drive axle and the tilting portion to tilt the ladder cord as the bottom member is moved toward the head rail.

11. The window covering according to claim 10, wherein the second torque applied by the motor spring assembly causes rotational displacement of the drive axle and the tilting portion to tilt the ladder cord when the bottom member is slightly displaced upward from a given vertical position.

12. An actuator mechanism for a blind having a head rail, a plurality of slats, a raising cord, a ladder cord extending from the head rail and supporting the plurality of slats for tilting movement thereof, a bottom member suspended from the raising cord, an upper end portion of the raising cord secured with the winding drum, and a drive unit operatively connected to the drive axle and adapted to rotate the drive axle in a first direction of rotation, the actuator mechanism comprising:

a rotatable drive axle disposed within the head rail;

a winding drum operatively coupled with the drive axle, the winding drum including a cylindrical shaft sleeve;

a rotary tilt control mechanism mounted within the head rail and adapted to adjust the ladder cord and cause tilting of the slats, wherein the tilt control mechanism includes a pulley around which the ladder cord is wrapped, the pulley comprising a sleeve portion mounted around the shaft sleeve;

a clutching arrangement operatively engageable with the winding drum and tilt control mechanism, the clutch arrangement including a coil spring having a pair of prongs, the coil spring being mounted around the sleeve portion of the pulley, and the winding drum engages the pair of prongs in a slot proximate the shaft sleeve, wherein the clutch arrangement rotationally disengages the winding drum and the tilt control mechanism in response to actuation of a stop arrangement limiting vertical adjustment of the ladder cord.

13. The actuator mechanism according to claim 12 having a first state in which the coil spring frictionally engages the sleeve portion of the pulley and a second state in which the coil spring disengages the sleeve portion of the pulley; and wherein the pulley and winding drum rotate in unison when the actuator mechanism is in the first state and wherein the winding drum rotates independently of the pulley when the actuator mechanism is in the second state.

* * * * *

UNITED STATES PATENT AND TRADEMARK OFFICE

CERTIFICATE OF CORRECTION

PATENT NO. : 8,281,843 B2
APPLICATION NO. : 12/799055
DATED : October 9, 2012
INVENTOR(S) : Fu-Lai Yu et al.

It is certified that error appears in the above-identified patent and that said Letters Patent is hereby corrected as shown below:

In the Specifications:

Column 8, line 13 change “54” to --24--

Column 11, line 36 change “54” to --24--

Column 11, line 42 change “54” to --24--

Column 11, line 45 change “54” to --24--

Column 11, line 63 change “54” to --24--

Column 12, line 2 change “54” to --24--

Column 12, line 4 change “54” to --24--

Signed and Sealed this
Fourth Day of June, 2013

Teresa Stanek Rea

Teresa Stanek Rea
*Acting Director of the United States Patent and Trademark Office*